United States Patent [19]

Brocklehurst et al.

[11] 4,204,012

[45] May 20, 1980

[54] SHEET INSPECTION AND MARKING SYSTEM

[75] Inventors: Charles E. Brocklehurst; Perry E. Burton, both of Fountain Inn, S.C.

[73] Assignee: Opelika Manufacturing Corp., Chicago, Ill.

[21] Appl. No.: 956,791

[22] Filed: Nov. 1, 1978

[51] Int. Cl.[2] ..... B05D 5/12; B05C 9/12

[52] U.S. Cl. ..... 427/288; 118/42; 118/669; 118/670; 118/681; 118/713; 427/293

[58] Field of Search ..... 118/9, 40, 8, 41, 42, 118/669, 670, 681, 713; 83/371; 427/293, 8, 256, 288

[56] References Cited

U.S. PATENT DOCUMENTS

| | | | |
|---|---|---|---|
| 2,091,522 | 8/1937 | Perry | 26/70 |
| 2,342,474 | 2/1944 | Klein et al. | 118/9 X |
| 3,290,167 | 12/1966 | Wood et al. | 118/8 X |

*Primary Examiner*—Evan K. Lawrence

*Attorney, Agent, or Firm*—Jones, Thomas & Askew

[57] ABSTRACT

A method and apparatus for inspecting and marking flawed sheet material is disclosed. Sheet material is moved from a supply along its length through a path to a cutter. The sheet material is visually inspected as it moves along its path, and a temporary electrically conductive mark is applied to the moving material at a predetermined distance away from any flaw that appears in the sheet material. The temporary mark is electrically detected at a position along the path the same predetermined distance away from the cutter as the flaw moves into the cutter, and as the last portion of the segment to be cut from the sheet material moves to the cutter, the sheet material is marked with a permanent mark. The sheet material is then cut and folded, and the permanent mark is located at a predetermined position in the folded segment of sheet material, no matter at what location in the segment of the sheet material the flaw appears.

14 Claims, 6 Drawing Figures

SHEET INSPECTION AND MARKING SYSTEM

BACKGROUND OF THE INVENTION

1. Field of the Invention

This invention relates to the field of cutting and hemming flat goods such as bed sheets, towels, etc., and particularly to a system that marks the finished product at a predetermined location on the product if the product bears a flaw that appears at any location on the product.

2. Description of Prior Art

When bed sheets, towels and other flat goods are manufactured, the sheet material is taken from a supply and moved along its length to a cutter which cuts the sheet material into shorter segments. In most instances, the side edges of the sheet material will be hemmed or otherwise edge treated as the sheet material is moved toward the cutter, and the end edges are hemmed after the cutting step. For example, U.S. Pat. Nos. 3,580,198 (Teed et al.), 3,772,948 (Burton) and 3,955,515 (Elsas) illustrate various cutting and hemming equipment. After the cutting and hemming steps have been completed, the product is usually folded and packaged for shipment to a retail merchant, etc. When the sheet material has a flaw, such as a tear in the material or a defect in the print applied to the material, the manufacturer must eliminate the flawed portion of the sheet material from the final first line products which are to be delivered to the retail merchant. In most instances the manufacturing procedures are not interrupted when a flaw appears in the sheet material and the flaw is observed by an inspector observing the final product. In other procedures an inspector watches the sheet material entering the equipment and when a flaw appears in the sheet material the inspector applies marks on the sheet material so that the final product can be identified as a "second." One procedure for marking the portion of the sheet material which includes a flaw comprises applying a strip of tape to the edge of the sheet material adjacent a flaw. The workers that receive the final product can identify the product as a "second" upon seeing the tape and can remove the product from the first quality goods. However, the movement of the sheet material through the humming and cutting apparatus usually must be interrupted to apply the tape or other mark to the sheet material. In some instances the tape and other items applied to the sheet material will be accidentally removed from the sheet material or transposed from a flawed portion of the sheet material to another area that does not bear a flaw, and when the final product is folded and packaged for shipment to a retail customer, etc., the product must be carefully inspected to find the tape, to assure that the product is identified as a "second."

SUMMARY OF THE INVENTION

Briefly described, the present invention comprises a sheet inspection and marking method and apparatus wherein sheet material is moved from a supply along a path into a cutter where the sheet material is cut into segments, and as the sheet material moves along its path toward the cutter temporary marks are applied to the sheet material at a predetermined distance behind the flaws in the sheet material. As the flaws and temporary marks approach the cutter, the temporary marks are detected at the same predetermined distance ahead of the cutter, as the flaw moves into the cutter, and in response to the detection of the temporary marks a permanent mark is applied to the last portion of the sheet material to move into the cutter prior to the cutting of the sheet material. This causes each cut segment of sheet material that bears a flaw anywhere on the cut segment of sheet material to also bear a visible mark at a predetermined position on the cut segment. The visible mark is applied adjacent a corner of the cut segment of sheet material, at one side edge and at the trailing edge moving into the cutter. Thus, when the sheet material is finally hemmed and folded for packaging and shipment, the permanent mark will have been applied to that portion of the folded sheet product that is at the surface of the folded product where it can be visually detected by the manufacturer, retail customer, etc.

The temporary mark applied to the sheet material is an electrically detectable liquid, such as a mixture of soap and water or potassium chloride and water, and a pair of electrical conductors spaced from each other and positioned on opposite sides of the sheet material detect the change in conductivity of the sheet as the wet spot on the otherwise dry sheet moves between the conductors, causing a change in condition of an electrical circuit that causes the application of a permanent visible mark to the sheet material at a location which will appear at a predetermined position on the final cut and hemmed product.

Thus, it is an object of this invention to provide a sheet inspection and marking system for use in a sheet cutting and hemming system, wherein each sheet that is cut and hemmed is marked at a predetermined location on the final product if a flaw appears anywhere in the final product.

Another object of this invention is to provide a method and apparatus for expediently and inexpensively marking final products at a predetermined location on each product with an indication that the product bears a flaw.

Another object of this invention is to provide a method and apparatus for use in a sheet manufacturing process which marks flaws appearing in the sheet material at a predetermined distance away from each flaw, which detects the movement of the mark at the same predetermined distance from a subsequent processing machine as the flaw moves into the processing machine, and marks the last portion of the sheet material to be moved into the processing machine before the processing machine is actuated.

Other objects, features and advantages of the present invention will become apparent upon reading the following specification, when taken in conjunction with the accompanying drawings.

DETAILED DESCRIPTION

Figure 1:
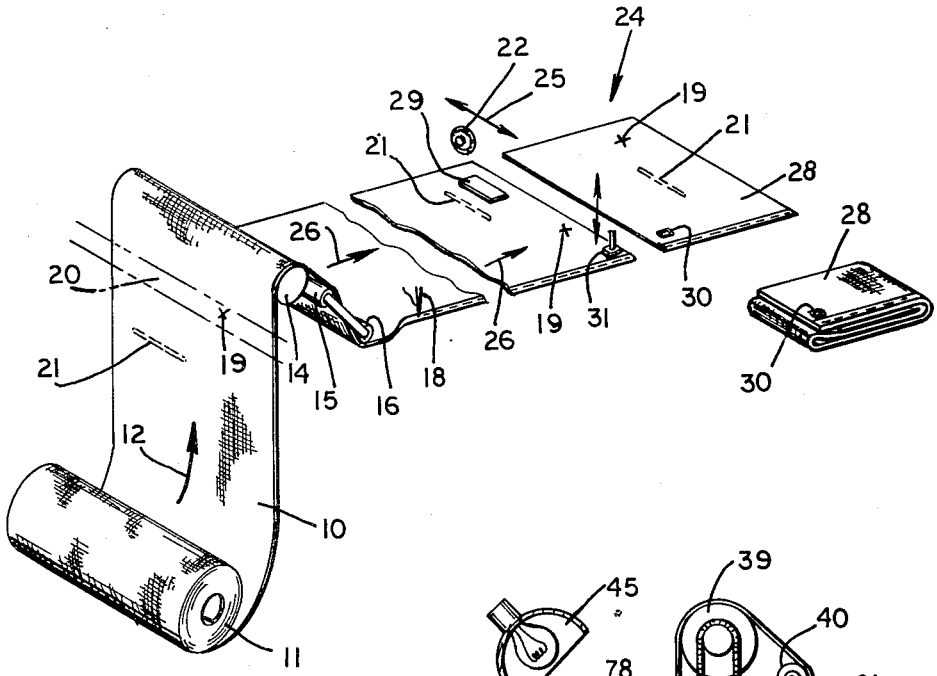
FIG. 1 is a perspective schematic illustration of the process of the sheet production system.

Referring now in more detail to the drawings, wherein like numerals indicate like parts throughout the several views, FIG. 1 illustrates the steps to be performed on the sheet material. The sheet material 10 is taken from a supply such as reel 11 and moved in an upward direction as indicated by arrow 12 over a drive roller 14, between dancer bars 15 and 16 to a sewing machine hemmer apparatus 18. The sheet material is illuminated by a back light as it moves up to the drive roller 14 so as to enable an inspector to detect any flaws such as flaw 19 that might be present in the sheet material. A stationary shadow 20 is cast in the sheet material as it moves up toward drive roller 14, and when the flaw 19 reaches the shadow 20, a temporary mark 21 is applied to the sheet material.

After the sheet material has been treated, as by having one or more of its side edges hemmed by a sewing machine hemmer apparatus 18, the sheet material moves past a cutter 22 into a cutting station 24, and the cutter is moved as indicated by arrows 25 across the direction of movement of the sheet material to cut a segment 28 of the sheet material.

Detection means 29 is located along the path of the sheet material at a location prior to the cutter 22, at a distance upstream from the cutter which is substantially equal to the distance that the temporary mark 21 is located from the flaw 19. Thus, as the flaw 19 moves past cutter 22, the temporary mark 21 moves past detection means 29, which effectively indicates that the flaw is now moving into the cutting station and will appear on the cut segment 28. As the last portion of the sheet material 10 which bears a flaw 19 moves into the cutting station prior to the operation of the cutter 22, a permanent mark 30 is applied to the sheet material by a second marking means 31. The permanent mark will be located at a predetermined poisition on the cut segment 28 while the flaw 19 can be located at any position in the cut segment. The cut segment 28 is subsequently moved out of the cutting station 24 and is folded in such a manner that the permanent mark 30 will appear on an outer layer of the folded segment of sheet material.

Figure 2:
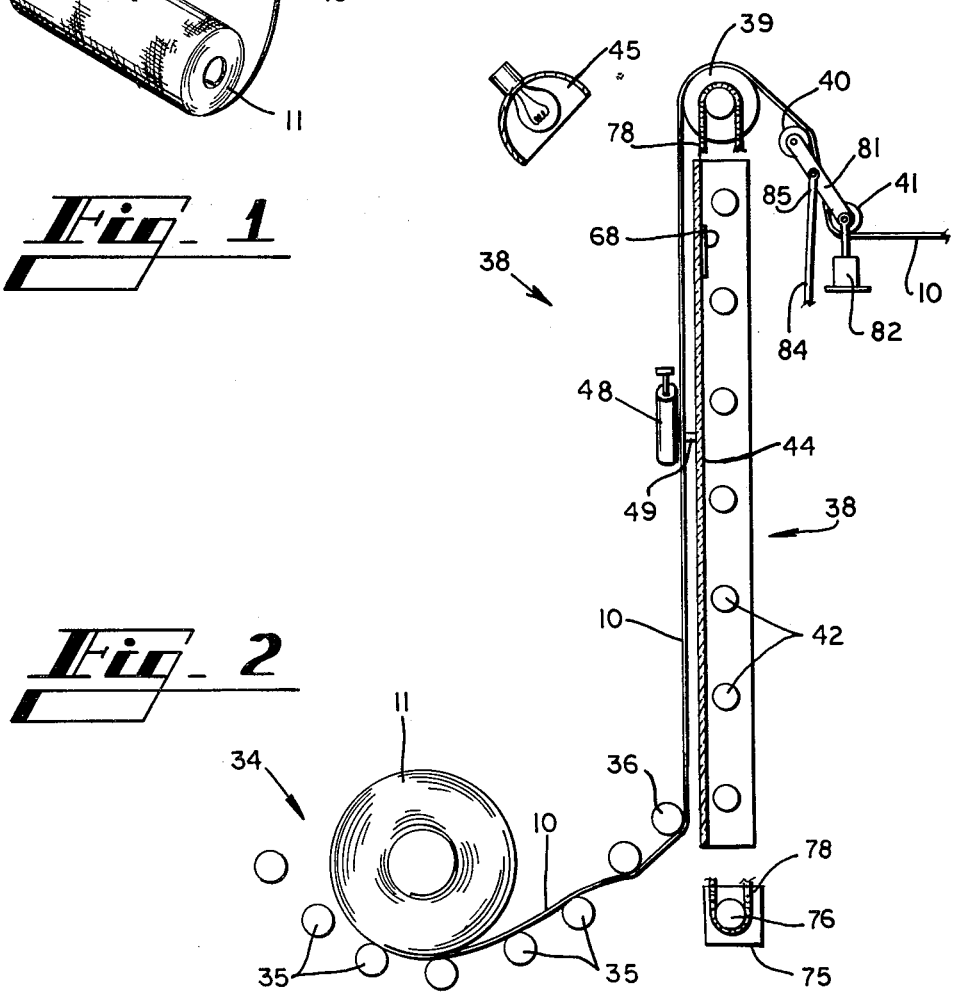
FIG. 2 is a side elevational view, with parts removed for clarity, of the sheet inspection section.

As illustrated in FIG. 2, the feed and inspection section 32 comprises a cradle 34 of idler rolls 35 for supporting a reel 11 of sheet material 10, and the sheet material is guided from the reel about guide rolls 36 in an upward direction in front of a back light apparatus 38 to a feed roll 39, then in a downward direction from the feed roll about a pair of dancer bars 40 and 41, and then from dancer bar 41 on into a subsequent section of the sheet cutting and hemming apparatus (not shown).

The back light apparatus 38 comprises a frame that supports a plurality of fluorescent lamps 42 adjacent a translucent screen 44 which illuminates the sheet material 10 as the sheet material moves in an upward direction to feed roll 39. An overhead light fixture 45 also directs its light to the front side of the sheet material 10.

First marking means 48 (FIGS. 2 and 4) is mounted on the framework of back light apparatus 38 by support bracket 49. First marking means 48 includes pneumatic cylinder 50 oriented at an angle of approximately 45° with respect to the horizontal, a cylinder rod 51, a spray nozzle 52 mounted in a support bracket 54 at the end of cylinder rod 51, coil tension spring 55 extending from bracket 54 to a bracket 56 mounted on cylinder 50, and connecting lines 58 extending from nozzle 52. One of the connecting lines 58 is liquid conduit 59 which extends from nozzle 52 to container 60 which functions as a reservoir for a mixture of water and soap. Another one of the connecting lines 58 comprises air conduit 61. The cylinder rod 51 of cylinder 50 is biased by its coil tension spring 55 to its retracted position. Air conduit 62 is connected to cylinder 50 and functions to supply air under pressure to the cylinder to distend cylinder rod 51 and to move nozzle 52 in an upwardly inclined angle across sheet material 10 as the sheet material moves in an upward direction as indicated by arrow 12. As schematically indicated, valves 64 and 65 control the passage of air under pressure through air conduits 61 and 62, thereby controlling the movement of nozzle 52 and the spray emitted from the nozzle.

Figure 4:
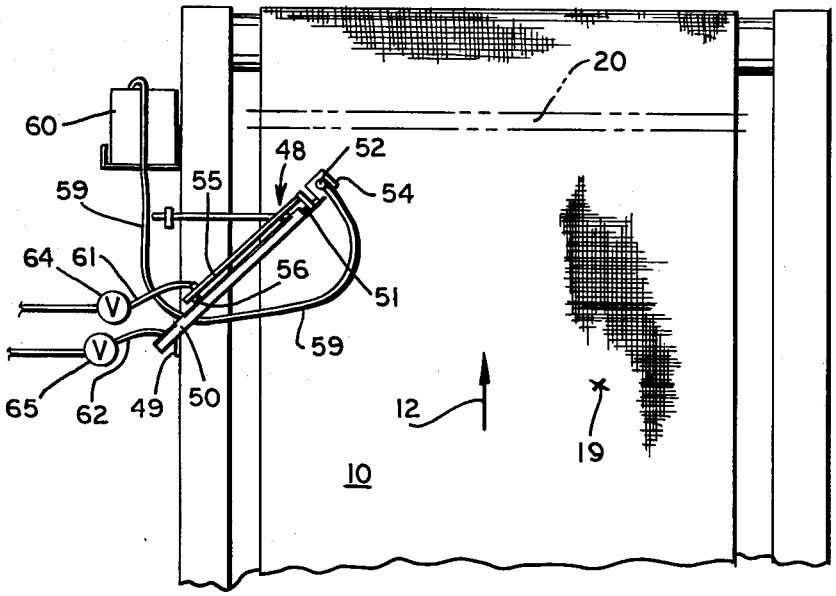
FIG. 4 is a partial front elevational view of the sheet inspection system.

As illustrated in FIGS. 2 and 4, a stationary shadow 20 is cast on the translucent screen 44 and thus upon moving sheet material 10 by a strip of opaque material 68 applied to translucent screen 44. When a flaw 19 moves with the sheet material 10 in an upward direction as indicated by arrow 12, the operator visually detects the flaw and waits for the flaw to reach the shadow 20 on the back light apparatus 38, and then the operator depresses a switch (not shown) which simultaneously opens both valves 64 and 65, thus beginning the outward movement of cylinder rod 51 of cylinder 50 and moving spray head 52 in an upward angled direction across back light apparatus 38, and thus causing nozzle 52 to emit a fine spray of air, water and soap against the sheet material 10.

Figure 5:
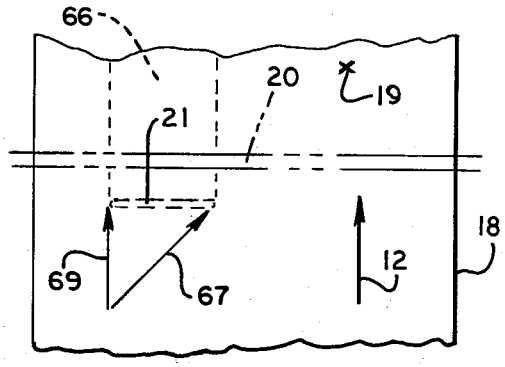
FIG. 5 is a vector diagram illustrating the manner in which the temporary mark is applied to the moving sheet material.

As illustrated in FIG. 5, the nozzle 52 moves at a velocity which has a vector 67 that extends at an upward incline across the back light apparatus 38. In the meantime, the sheet material 10 moves in an upward direction, and the component 69 of the velocity represented by velocity vector 67 is the same as the velocity 12 of the sheet material in an upward direction. The other component of velocity of the spray head extends at a right angle to the component 69 and to the velocity 12 of the sheet material, thus causing the temporary mark 21 applied to the sheet material 10 by the nozzle 52 to extend at a right angle with respect to the direction of the path of movement of the sheet material. Also, the temporary mark 21 will be positioned behind the flaw 19 a predetermined distance since the flaw 19 was allowed to reach the shadow line 20 before the spray nozzle was actuated, and since the spray nozzle 52 is located beneath or behind the shadow line 20. With this arrangement, each flaw 19 that is detected by the operator is marked on the sheet material, but the mark will be spaced a predetermined distance behind the flaw, the mark will extend across the direction of movement of the sheet material, and the mark will always be located a predetermined range of distances from one edge of the sheet material in a path 66 adjacent one edge of the sheet material.

Figure 3:
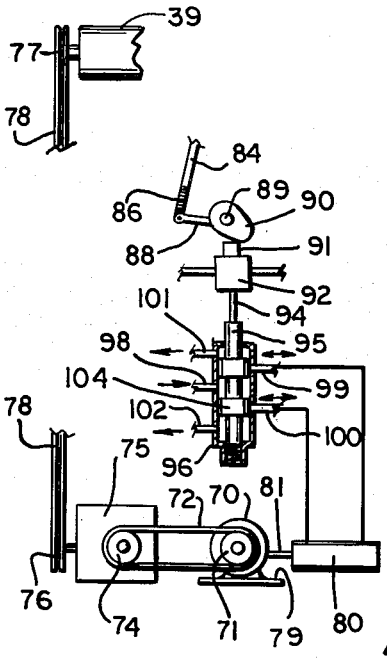
FIG. 3 is a schematic illustration of the variable speed drive system for driving the sheet inspection section.

As indicated in FIG. 3, the feed roll 39 of the feed and inspection section 32 is driven by clutch brake motor 70 through a variable pitch drive sheave 71, V-belt 72, sheave 74, gear box 75, sprockets 76 and 77 and continuous chain 78. Clutch brake motor 70 is movably mounted on support 79 and pneumatic cylinder 80 has its cylinder rod 81 connected to the motor housing and functions to move the motor 70 toward and away from gear box 75, thus causing the pitch of the variable pitch sheave 71 to change. This causes the belt 72 to operate at variable speeds.

The sheet material 10 moves over dancer bar 40 and beneath dancer bar 41. Dancer bar 41 is swingably supported by end support straps 81 from the ends of stationary dancer bar 40, and weights 82 are connected to swingable dancer bar 41, if necessary. A connecting rod 84 has its upper end portion 85 connected to one of the end support straps 81, and its lower end portion 86 is connected by crank 88 to cam shaft 89. Cam 90 is mounted on rotatable cam shaft 89 and is arranged to engage plunger 91 of air valve 92. Air valve 92 is continuously charged with air and functions to divert air through outlet conduit 94 to the pilot 95 of control valve 96. Control valve 96 is a conventional air regulator valve and includes a supply port 98, delivery ports 99 and 100, and exhaust ports 101 and 102 which are controlled by spool 104. Air under pressure communicates with supply port 98 and is directed through either delivery port 99 or 100 to control the cylinder rod 81 of pneumatic cylinder 80, and thereby control the position of motor 70 and the velocity of V-belt 72. Thus, when feed roll 39 has supplied an excessive amount of the sheet material 10 to the subsequent cutting and hemming sections of the apparatus, dancer bar 41 will move down into the slack of the material, thereby pushing connecting rod 84 down, and crank 88 rotates cam 90 which changes the setting of air valve 92 and moves the spool 104 of the air valve, causing a shifting of the cylinder rod 81 of cylinder 80 and shifting of motor 70 away from the gear box 75, thereby decreasing the velocity of V-belt 72 and the angular velocity of the feed roll 39. When the slack is reduced in th sheet material 10, the opposite procedures take place, causing the angular velocity of the feed roll to increase.

Figure 6:
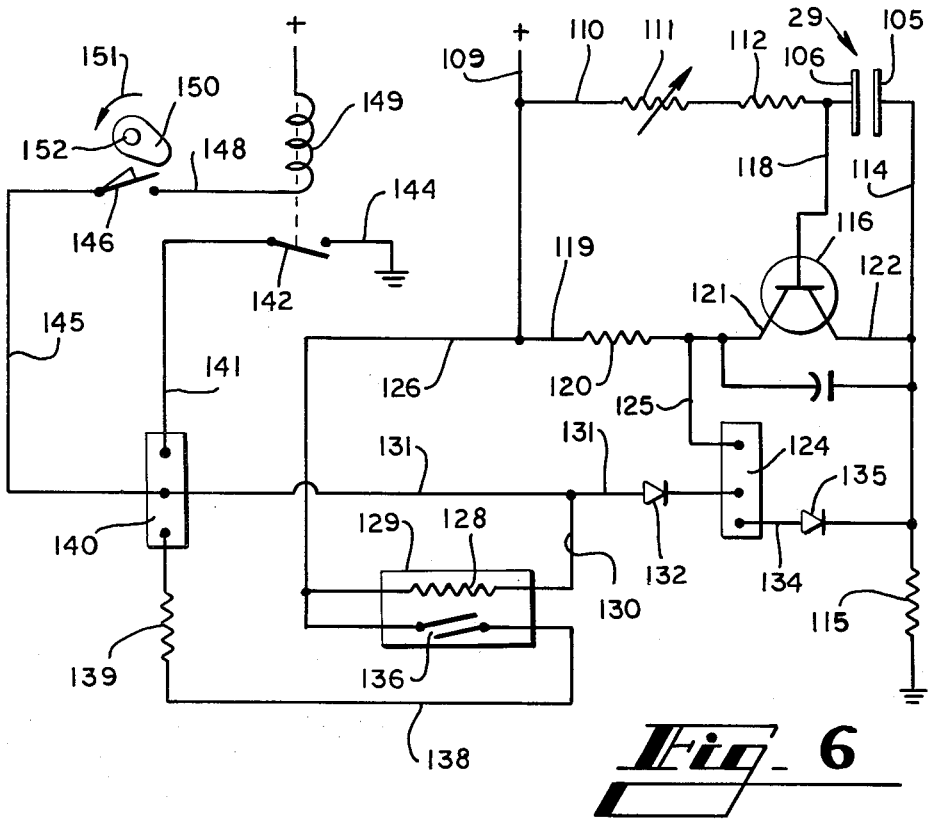
FIG. 6 is an electrical schematic illustration of the control circuitry of the sheet marking section.

As illustrated in FIG. 6, the detection means 29 comprises a pair of electrical conductors 105 and 106 which are closely spaced with respect to each other and which are located on opposite sides of the sheet material 10 (FIG. 1) as the sheet material moves to cutting station 24. The conductors 105 and 106 are in a control circuit 108 (FIG. 6) and form a circuit from conductor 109 through conductor 110, variable resistance 11, fixed resistance 112, and to conductor 114, resistance 115 to ground. When the sheet material passes through the conductors 105 and 106, the resistance of the dry sheet material is high enough so that transistor 116 is biased through conductor 118 and a circuit is made through conductors 109, 119, resistance 120, conductor 121, transistor 116, and conductors 122 and 114 to ground. This keeps transistor 124 in an off condition since the bias to transistor 124 through conductor 125 is too weak to place the transistor 124 in its on condition. When a temporary mark 21 of water and detergent appears on sheet material 10 and passes between conductors 105 and 106, the resistance between the conductors is lowered, making a circuit through the conductors. This reduces the bias to transistor 116, causing transistor 116 to shift to its off condition. As a result, the bias through conductors 109, 119 and 125 to transistor 124 is increased, thereby making a circuit from conductor 109, conductor 126, coil 128 of latch relay 129, conductor 130, conductor 131, through diode 132 to transistor 124, through conductor 134, diode 135, to conductor 114, to ground. The coil 128 of latch relay 129 causes its contacts 136 to close, thereby making a circuit through conductors 109, 126, contacts 136, conductor 138, resistance 139, to output transistor 140. This biases output transistor 140 so that a holding circuit is made through conductors 109, 126, coil 128, conductors 130, 131 to transistor 140, through conductor 141, stamp switch 142, conductor 144, to ground. A circuit is also made from output transistor 140 through conductor 145, normally open cam switch 146, conductor 148, and the coil 149 of the stamp switch 142. When the temporary mark of water and detergent on the sheet material 10 passes beyond the conductors 105 and 106, the holding circuit through latch relay 129 continues.

Normally open cam switch 146 is periodically closed upon each rotation of cam 150 in the direction as indicated by arrow 151. Cam 150 is located on cam shaft 152, and cam shaft 152 is synchronized with the feeding apparatus (not shown) of the sheet material beyond cutter 22 (FIG. 1), so that cam 150 depresses and closes cam switch 146 as the last of the sheet material is fed into the cutting station 24. When the cam switch 146 is closed, a circuit is then made from output transistor 140 to the coil 149 of the stamp switch 142. The stamp switch causes a marking stamp (FIG. 1) as indicated at 31 to move downwardly into engagement with the sheet material 10, leaving a permanent mark of visible ink on the sheet material. Thus, the stamp functions as a second marking means to apply a visible mark 30 to the sheet material. The downward movement of the stamp also opens the normally closed stamp switch 142, thus breaking the circuit through transistor 140. The opening of the circuit through the transistor 140 also opens a circuit to latch relay 129. Thus, when the electrical conductors 105 and 106 detect another electrically conductive temporary mark in the moving sheet material, the control system is in a state where it is ready to begin its detection, delay and marking functions again.

It will be noted that the control system as shown in FIG. 6 and described herein functions first to detect the electrically conductive temporary mark in the sheet material, which is effectively detecting the movement of a flaw past cutter 22, and then, only after waiting for the program switch 146 to close, functions to apply the permanent mark 30 to the sheet material. Thus, the permanent mark 30 will always be applied at a predetermined position on the segment 28 of sheet material 10, no matter where the flaw 19 appears in the segment.

While a mixture of water and soap is disclosed herein as being the electrically conductive liquid applied to the sheet material, it will be understood that various other detectable substances can be applied to the sheet material, and the detectors can comprise various other detecting systems, as may be desired. Moreover, while the system is disclosed in combination with a sheet cutting and hemming system, it will be understood that the sheet inspection and marking system can be used in other apparatus that does not necessarily function to cut the work product into segments.

While this invention has been described in detail with particular reference to a preferred embodiment thereof, it will be understood that variations and modifications can be effected within the spirit and scope of the invention as described hereinbefore and as defined in the appended claims.

We claim:

1. A method of marking a cut segment of sheet material bearing a flaw or the like comprising the steps of moving the sheet material from a supply along its length past a cutter into a cutting station, cutting across the sheet material with the cutter to form the sheet material into cut segments of predetermined length at the cutting station, and as the sheet material is moved toward the cutting station, inspecting the sheet material for the purpose of detecting flaws in the sheet material, applying a detectable substance to the sheet material at a position adjacent a flaw in the sheet material, detecting the detectable substance as the flaw in the sheet material moves into the cutting station, and in response to the detection of the detectable substance and to the movement of a predetermined portion of the flawed segment to be cut into the cutting station marking the segment of the sheet material which bears the flaw at a location which appears at a predetermined position on the cut segment of sheet material.

2. The method of claim 1 and wherein the step of applying a detectable substance to the sheet material comprises applying the detectable substance to the sheet material at a predetermined distance behind the flaw, and wherein the step of detecting the detectable substance comprises detecting the detectable substance at the same predetermined distance before the cutting station.

3. The method of claim 1 and wherein the step of inspecting the sheet material comprises moving the sheet material adjacent an illuminated surface, and wherein the step of applying a detectable substance to the sheet material comprises spraying a liquid on the moving sheet material beginning at a first predetermined position with respect to the illuminated surface as the flaw in the sheet material reaches a predetermined position with respect to the illuminated surface.

4. The method of claim 1 and wherein the step of applying a detectable substance to the sheet material comprises applying an electrically conductive liquid to the sheet material, and wherein the step of detecting the detectable substance comprises conducting electricity through the liquid.

5. The method of claim 1 and wherein the step of applying a detectable substance to the sheet of material comprises spraying an electrically conductive liquid onto the sheet material in a pattern extending across the direction of movement of the sheet material, and wherein the step of detecting the detectable substance comprises passing the portion of the sheet material which bears the electrically conductive liquid between a pair of closely spaced electrically charged electrical conductors.

6. The method of claim 1 and wherein the step of marking the sheet material comprises applying a visible mark to the sheet material.

7. A method of marking sheet material bearing a flaw or the like comprising moving the sheet material along its length into a sheet cutting station, cutting across the sheet material at the cutting station to form the sheet material into segments, and as the sheet material is moved toward the cutting station applying a detectable substance to the sheet material at a flaw in the sheet material, detecting the detectable substance as the flaw moves into the cutting station, and in response to the detection and in response to the movement of the last portion of the segment into the cutting station applying a mark to a predetermined portion of the segment of sheet material which moves into the cutting station and which bears a flaw.

8. A method of marking sheet material bearing a flaw or the like comprising moving the sheet material along a path into a cutter, cutting the sheet material into segments with the cutter, applying a detectable temporary mark to the sheet material at a predetermined distance behind a flaw in the sheet material as the sheet material moves to the cutter, detecting the temporary mark of the flaw at the same predetermined distance along the path prior to the cutter, and in response to detecting the temporary mark and in response to the movement of the flawed segment into the cutter applying a permanent mark to a predetermined portion of the flawed segment of the sheet material moved into the cutter.

9. Apparatus for marking sheet material bearing a flaw or the like comprising sheet cutting means for cutting the sheet material into segments, conveyor means for moving the uncut sheet material from a supply along its length through a path to said cutting means, first marking means positioned along the path for applying a detectable mark to the sheet material at a predetermined distance from a flaw in the sheet material, detection means positioned along the path between said first marking means and said cutting means for detecting the detectable mark on the sheet material, length measuring means for detecting the movement of the last portion of the sheet material into said cutting means prior to cutting the sheet material, second marking means positioned along the path between said detection means and said cutting means responsive to said detection means and to said length measuring means for applying a second mark to a predetermined portion of the flawed segment of the sheet material moved into said cutting means.

10. The apparatus of claim 9 and wherein said first marking means comprises a back lighted panel including means for casting a linear shadow on the sheet material across the direction of movement of the sheet material, a nozzle supported adjacent said panel, means for moving said nozzle across said panel and the sheet material moving adjacent said panel at a velocity having one component of velocity approximately equal to the velocity of the sheet material and having another component of velocity extending approximately at a right angle with respect to the velocity of the sheet material, and means for directing a spray electrically conductive liquid from said nozzle to the sheet material.

11. The apparatus of claim 9 and wherein said detection means comprises a pair of closely spaced electrically charged electrical conductors, said conductors being positioned on opposite sides of the path of the sheet material at a predetermined distance along the path prior to said sheet cutting means, and wherein said first marking means comprises means for applying electrically conductive liquid to the sheet material at a distance behind a flaw which is approximately equal to said predetermined distance, whereby the detection means detects an electrically conductive liquid mark in the sheet material as a flaw in the sheet material moves past the sheet cutting means.

12. Apparatus for marking sheet material bearing a flaw or the like comprising sheet cutting means for cutting the sheet material into segments, conveyor means for moving the uncut sheet material from a supply along its length through a path into said cutting means, first marking means positioned along the path for applying electrically detectable marks to said sheet material at a predetermined distance along the direction of movement of the sheet material from the flaws in the sheet material, detection means positioned along the path between said first marking means and said cutting means a distance along the path from said sheet cutting means corresponding to said predetermined distance for detecting the detectable marks on the sheet material as the flaws move into the cutting station, and second marking means along the path between said detection means and said cutting means responsive to said detection means for applying visible marks to a predetermined portion of the sheet material moved into said cutting means, whereby each cut segment of sheet material that bears a flaw anywhere on the cut segment of sheet material also bears a visible mark at a predetermined position thereon.

13. The apparatus of claim 12 and wherein said first marking means comprises means for applying an electrically conductive liquid to the sheet material in linear pattern extending approximately at a right angle with respect to the path of movement of the sheet material.

14. The apparatus of claim 13 and wherein said detection means comprises a pair of closely spaced electrically charged conductors.

* * * * *